US008755530B2

(12) United States Patent
Kron

(10) Patent No.: US 8,755,530 B2
(45) Date of Patent: Jun. 17, 2014

(54) METHOD FOR MULTI-CHANNEL PROCESSING IN A MULTI-CHANNEL SOUND SYSTEM

(75) Inventor: Gunnar Kron, Hamburg (DE)

(73) Assignee: Kronoton GmbH, Hamburg (DE)

( * ) Notice: Subject to any disclaimer, the term of this patent is extended or adjusted under 35 U.S.C. 154(b) by 0 days.

(21) Appl. No.: 12/737,692

(22) PCT Filed: Dec. 29, 2008

(86) PCT No.: PCT/EP2008/011128

§ 371 (c)(1),
(2), (4) Date: Feb. 7, 2011

(87) PCT Pub. No.: WO2010/015275

PCT Pub. Date: Feb. 11, 2010

(65) Prior Publication Data

US 2011/0129091 A1 Jun. 2, 2011

(30) Foreign Application Priority Data

Aug. 8, 2008 (DE) ..... 10 2008 036 924

(51) Int. Cl.
*H04R 5/00* (2006.01)

(52) U.S. Cl.
USPC ..... 381/17; 381/22; 381/23; 381/106

(58) Field of Classification Search
CPC ..... H04R 5/00; G10L 19/00
USPC ..... 381/17, 22–23, 307, 27, 119, 109, 104; 704/200, 200.1, 500–501, 503–504, 704/E19.001
See application file for complete search history.

(56) References Cited

U.S. PATENT DOCUMENTS

| | | | | |
|---|---|---|---|---|
| 8,073,160 | B1 * | 12/2011 | Classen | 381/119 |
| 2004/0213420 | A1 * | 10/2004 | Gundry et al. | 381/104 |
| 2005/0195995 | A1 * | 9/2005 | Baumgarte | 381/104 |
| 2006/0106620 | A1 * | 5/2006 | Thompson et al. | 704/500 |

OTHER PUBLICATIONS

International Search Report.
Dolby Laboratories, Inc. "DP563 Dolby Surround and Pro Logic II Encoder User's Manual," [Online] 2003, XP002523630, Retrieved from the Internet: URL: http://www.dolby.com/uploadedFiles/zz-_Shared_Assets/English_PDFs/Professional/148_563_2.Manual.pdf>. (ISR).

(Continued)

*Primary Examiner* — Disler Paul
(74) *Attorney, Agent, or Firm* — Collard & Roe, P.C.

(57) ABSTRACT

A method for multi-channel processing in a multi-channel sound system, in which a channel or a channel mixture is first split into individual channels, the individual channels are limited by setting the values of the parameters channel fader, threshold, release, and output level and then encoding the individual channels. At least two channels are compressed and/or limited with a uniform output level value in method step, one channel is provided with a deviating output level value, which is set, depending on the audio material to be processed, and every further channel is compressed and/or limited in such a manner that it has an output level value that is at least one decibel less than the uniform output level value. The individual channels are combined into an encoded (coded) channel by setting a value of at least one of the parameters channel fader, threshold, release, and output level.

10 Claims, 5 Drawing Sheets

(56) References Cited

OTHER PUBLICATIONS

Dolby Laboratories, Inc. "Mixing Information for Dolby Pro Logic II," [Online] 2005, XP002523504, Retrieved from the Internet: URL: http://www.dolby.com/uploadedFiles/zz-__Shared__Assets/English__PDFs/Professional/214__Mixing%20with%20Dolby%20Pro%20Logic%20II%20Technology.pdf>. (ISR).

Benson, K. B., "Audio Engineering Handbook," 1988 McGraw Hill, New York, US, XP002523505, ISBN 0-07-004777-4, p. 14.28-p. 14.44. (ISR).

Hilson, Jim; Gray, David, Dicosimo, Michael, "Dolby Surround Mixing Manual," [Online] 2005, XP007906506, Retrieved from the Internet: URL:http://www.dolby.com/uploadedFiles/zz-__Shared__Assets/English__PDFs/Professional/44__SurroundMixing.pdf>. (ISR).

Christian Birkner, Surround, Einführung in die Mehrkanaltontechnik [Surround, introduction to multi-channel sound technology], PPV Presse Projekt Verlags GmbH [publisher], Bergkirchen, 2002). (Spec, p. 4).

* cited by examiner

METHOD FOR MULTI-CHANNEL PROCESSING IN A MULTI-CHANNEL SOUND SYSTEM

CROSS REFERENCE TO RELATED APPLICATIONS

This application is the National Stage of PCT/EP2008/011128 filed on Dec. 29, 2008, which claims priority under 35 U.S.C. §119 of German Application No. 10 2008 036 924.1 filed on Aug. 8, 2008, the disclosure of which is incorporated by reference. The international application under PCT article 21(2) was not published in English.

BACKGROUND OF THE INVENTION

The invention relates to a method for multi-channel processing in a multi-channel sound system, particularly using surround multi-channel sound technology, having the following method steps:

a) splitting a channel or a channel mixture into individual channels;
b) processing the resulting individual channels by means of setting the parameter channel fader;
c) limiting the individual channels by means of setting the values of the parameters channel fader, threshold, release, and output level; and
d) encoding the individual channels.

The development of multi-channel sound systems has particularly been driven forward by the Dolby laboratories. Tied in with the "Dolby-Surround" invented in the 70s by the Dolby laboratories, in the meantime so-called "matrix surround methods" exist, such as, for example, Dolby ProLogic, ProLogic 2, Circle Surround, Circle Surround 2. In this way, the possibility is created of encoding (coding) up to 7.1 channels, i.e. the channels FL (FL=front left), C (C=center), FR (FR=front right), the side surround channels LS (left surround), RS (right surround), the back surround channels BL (back left), BR (back right), as well as the channel LFE (low frequency effect). From these channels, two transmission channels Lt (L=left, t=total), Rt (R=right, t=total) are matrixed, which contain all the data so that they can be distributed to the original channels again, by corresponding decoders, i.e. reproduced as the original channels after decoding. In the encoding (coding), the audio components of the data that lie in the surround channels LS, RS, BL, BR, are added to the channels L and R with a phase rotation by +/−90°, and embedded in the front channels R, L with slight lowering of the volume level. This encoding of the individual channels is preceded by further method steps in multi-channel sound processing: A first step in the usual multi-channel processing process, in the sector of upmixing of audio material from stereo/mono to surround of any configuration, is splitting a channel or a channel mixture into individual channels. This splitting can be implemented by means of corresponding software. After splitting, the individual channels are available for further processing, particularly in order to guarantee the stability of the multi-channel mix in comparison with the original, for example stereo mix, by means of multi-channel compressing/limiting. For this purpose, a compressor/limiter is provided. A compressor/limiter is a limiter that prevents a peak level from being exceeded, in order to prevent overloads. Also, they can be understood as volume/loudness regulators of instrument groups/singing or speech. Furthermore, they compensate part of the energy loss that results from splitting up a channel or a channel mixture into the individual channels, even before encoding. In this connection, a compressor/limiter is assigned to each individual channel or channel groups. The ratio of the individual channels relative to one another is regulated by means of setting the values of the parameters channel fader, threshold, attack (if available), release, as well as output level (output level) within a compressor or/and limiter. The regulation has the result that the volume/loudness balance of the individual channels relative to one another is already stabilized before encoding. The channel fader volume serves to regulate the volume of each individual channel in a mixing console, which is an important component of a sound studio. The normal volume setting of a channel fader is 0 dB. If one sets a channel fader to 0 dB, then the signal originally applied to the individual channel sounds exactly the same way as it was originally adjusted, presuming a correctly measured and neutrally set gain value at the corresponding channel strip. The channel gain value regulates the pre-amplification of a signal before it passes through the channel fader. The threshold value acts like a threshold of the signal that is applied to the channel fader. In this connection, a compressor/limiter works in such a manner that the compressor/limiter limits the signal as soon as the applied signal exceeds the threshold value. The release value gives information about the time that the compressor/limiter needs to be brought to the zero position again, after the applied signal has dropped below the threshold value again. The attack value determines the reaction time when the threshold value is exceeded. Finally, the output level indicates how strong the signal applied to the channel is after processing by the compressor/limiter. The output leveler is essentially a signal amplifier.

The method of the type indicated initially finds hardly any or only little acceptance within the scope of the matrix surround technology outlined here. It is true that it is confirmed in the relevant technical literature that the matrix surround technology cannot keep up with today's discrete digital methods (see, for example, Christian Birkner, "Surround, Einführung in die Mehrkanaltontechnik [Surround, introduction to multi-channel sound technology], PPV Presse Projekt Verlags GmbH [publisher], Bergkirchen, 2002).

This results, among other things, from the recognition that the Lt, Rt stereo sum created according to the common technical standards, seen in and of itself, cannot keep up qualitatively in comparison with the conventionally produced stereo mixes such as those that are generally processed at one hundred percent within the programs, in the TV sector, radio sector, and music sector. The phase rotations that are caused by the encoding weaken the sound and influence the frequency response, so that they sound "smaller and spongier."

On the other hand, the matrix surround technology fulfills all the demands on a usable compatible surround system.

SUMMARY OF THE INVENTION

In view of these problems and taking the state of the art as presented into consideration, the present invention is therefore based on the task of further developing a method of the type indicated initially, in such a manner that the Lt, Rt encoded surround mixes not only function as data carriers, but rather exist in parallel, also in and of themselves, as compared with stereo and mono, and can improve their quality, as needed, by means of processing by means of the invented method.

This task is accomplished with the characteristics of claim 1. Advantageous embodiments of the invention manifest themselves in the dependent claims.

According to the invention, the channel faders are set to a uniform value and in method step c), at least two channels are limited with a uniform output level value, whereby a channel C (center) can vary in terms of output level value, and every further channel is limited in such a manner that it has an output level value that is at least one decibel lower than the uniform output level value of the two channels, whereby subsequent to method step d), further compression and/or limiting of the encoded channels takes place by means of setting a value of at least one of the parameters channel fader, threshold, release, and output level.

Accordingly, individual channels, preferably five individual channels, can be set to a uniform channel fader value (volume), for example, at first, in method step b), in the basic setting. The sixth channel within a 5.1 system would then receive a higher channel fader value, for example, depending on the audio material to be processed. This value preferably amounts to between 0.1 to 5 dB. This basic setting can then either be maintained over the entire processing, within the scope of the invention, or also changed manually. This would hold true for all six channels (example of a 5.1 configuration). After standardized or manual setting of the channel fader values, the signals are then sent on for limiting in method step c).

According to the invention, therefore, at least two channels can be limited with a uniform output level value, at the same setting of the threshold and release, whereby one channel is freely set both in the threshold and in the output level, within specific default values, specifically depending on the audio material to be processed.

The invention is based on the recognition that uncontrolled splitting of the energy accompanies splitting into the individual channels, and this in turn has effects on the volume/loudness constellation, as well as on the phasing within the mix. If, for example, one splits a finished stereo mix that had been harmoniously optimized on channels FL and FR, and in terms of volume and loudness, this has the result that the original balance is permanently destroyed. Neither the balance, the phasing, nor the volume/loudness constellation within the mix are then retained. Splitting the energy therefore results in weakening of the individual channels. The fundamental idea of the invention is now to set the balance between the individual channels, by means of limiting, in such a manner that the original style mix is restored, or actually improved in terms of tone and expression. According to the invention, the phasing within the surround mix is already stabilized before encoding, by means of the constellation of the channel faders (method step b)) and limiting. According to the invention, the optimal loudness is achieved by means of further limiting subsequent to method step d), in that a value of at least one of the parameters channel fader, threshold, release, and output level is set.

The first limiting known from the state of the art and manifesting itself in method step c) is used in the surround sector, in general, in order to preserve the greatest possible volume in the mix. However, it does not serve for stabilization of the split-up channels, according to the invention. Another idea of the invention is that contrary to prevailing opinion, further limiting of the individual channels takes place subsequent to method step d). Since encoded surround mixes have a poor sound in a direct comparison with stereo and mono mixes, they are less suitable for continuous programming, such as radio and TV, for example, since here, the encoded mix competes with stereo and mono mixes. The invention therefore provides that after encoding, a limiter in the form of a maximizer is incorporated, in order to optimize the loudness, i.e. the energy of the mix, as well as the sound. The result is surround-encoded mixes that behave in absolutely equivalent manner in the stereo and mono context. By means of this limiting, the energy of a stereo or mono mix is also maintained, whereby a sound is produced that corresponds to that of a stereo original or actually improves it.

Furthermore, an advantage of the invention can be seen in that the surround-encoded mix is more phase-stable.

Another advantage is that stereo-encoded mixes clearly sound better than the previously known stereo after processing by means of the invented method. In addition, the hearing space of the consumer is included by this method, so that the stereo mixes encoded in this manner sound more transparent, multi-dimensional, and more intense.

Furthermore, it is also possible, by-means of this method, to process stereo mixes that have already been encoded in a matrix surround process of any kind, in such a manner that they are also transformed into the new stability and sound quality, in any audio configuration.

Another application sector is the conversion of existing individual channels created for a digital surround method into the new result. For example, Dolby Digital and dts production can be made audible to consumers who do not have any digital decoding equipment available—with full stereo and mono compatibility.

Within the scope of the invention, in this connection, a uniform value of the channels FL and FR can be set for the output level, in method step c), whereby preferably, an output level value between −8.0 dB (dB=decibel) and −24.0 dB is set. The output level value of the channel C is freely adapted, depending on the audio material to be processed. Preferably, the output level value of this channel differs from the channels FR and FL by +1-+6 dB. In order to limit up to 7.1 channels, another advantageous embodiment of the invention provides that in method step c), a uniform output level value of the channels Ls, Rs, Bl, Br, LFE is additionally set. In this connection, it has proven to be particularly effective to set an output level value between −9.0 dB and −25.0 dB, a channel fader value between 7.0 dB and 10.0 dB, a threshold value between −1.0 dB and −10 dB, as well as a release value between 0.5 and 2.0.

Furthermore, for further limiting subsequent to method step d), it has proven to be particularly advantageous to set a threshold value between −1.0 dB and −10.0 dB, an output level value between 0 dB and −1.0 dB, as well as a release value between 0.5 and 2.0.

Within the scope of the invention, it is furthermore possible to influence the frequencies of a mix by means of the optional use of a multi-band compressor per channel. By means of emphasizing or diminishing a corresponding frequency range, it is possible to repeat the lost frequencies that occurred during the change of the sound within the scope of decoding from two to six channels, for example, in targeted manner. This effect can therefore be equated with that of an equalizer, which can also be used as an alternative to the multi-band compressor.

Likewise, it can be advantageous to undertake decompression per individual channel, in method step b), with corresponding starting material. The invention has come to the realization that decompression per individual channel after splitting yields a higher-quality result than the decompression of the total to be split up, before method step a), which was frequently used until now. A decompressor is a compressor that is equipped with the parameters threshold, attack, release, ratio, and output level. Setting of a ratio value below the value 1.00, as well as long attack and release values, can lead to more dynamic results for corresponding starting material that had already been disadvantageously mastered in itself, with overly hard or with brick wall compression. Presuming a threshold and output level setting adapted to the starting material.

Finally, the invention provides for the use of the method for a recording medium, an audio carrier, a digital data set, as well as a conversion automation from conventional audio formats all the way to the new sound possibilities. This can be built into audio/video equipment or also be operated as stand-alone hardware or software, as well as be implemented in software-based and hardware-based host applications.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE INVENTION

Figure 1:
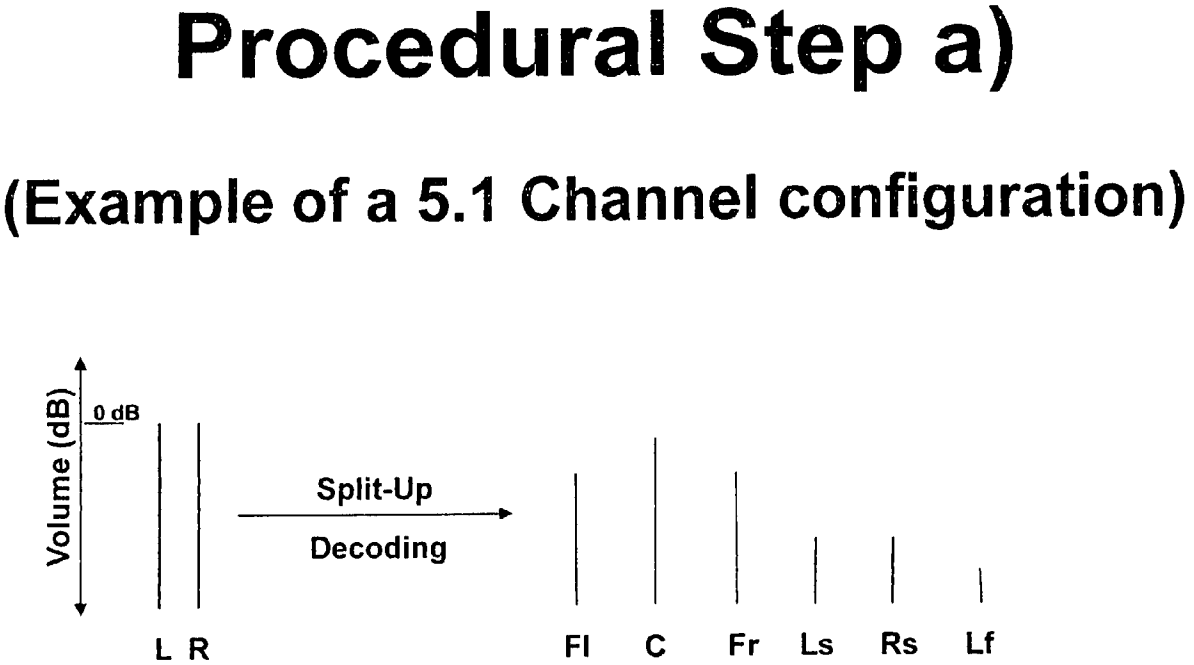
FIG. 1 shows an example of a 5.1 channel configuration according to procedural step a) of the present invention.

In the following, a particularly preferred embodiment of the invention will be presented, using a 5.1 channel surround system, with the following set parameters:

Limiting Before Encoding using Example 5.1 a) As shown in FIG. 1, the channel faders FL, FR, Ls, Rs, LFE of the audio tracks previously split up have a setting of 0 dB; the channel fader value of C deviates upward, depending on the audio material to be processed.

In the mixing console, the channel faders regulate the volume of each channel. The normal volume setting of a fader is 0 dB. The channel fader is set to 0 dB, so that the signal applied to the channel sounds the way it was originally adjusted, presuming a correctly measured and neutrally set gain value.

Figure 2:
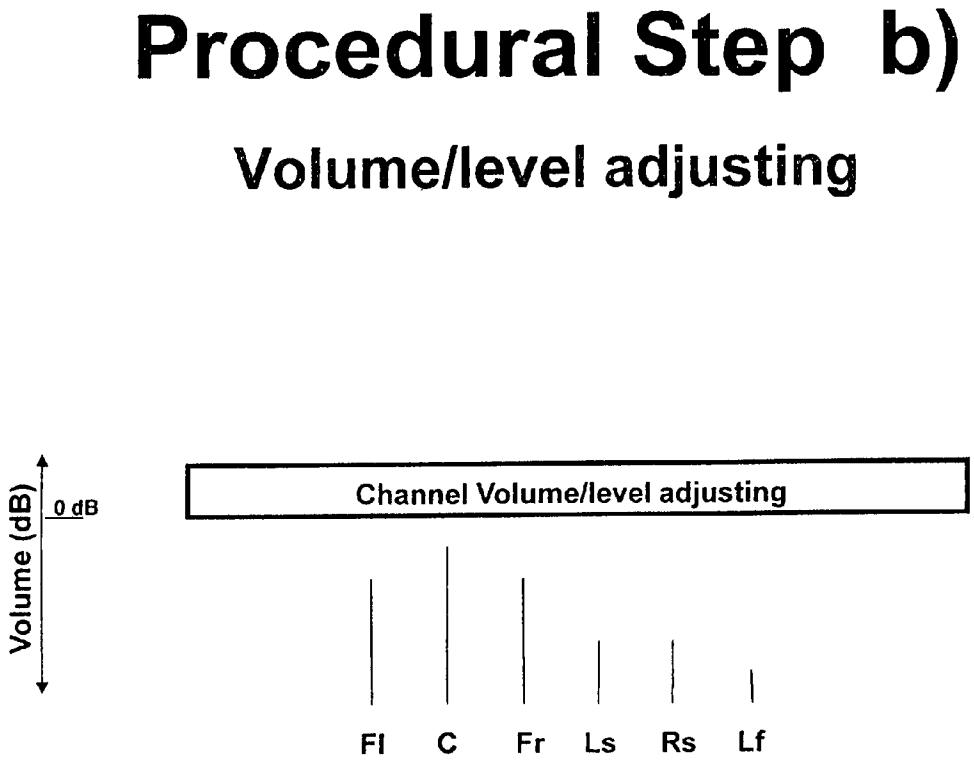
FIG. 2 shows the volume/level adjusting of procedural step b) of the invention.

After this configuration, the signals are sent on to the channel faders with limiters.

b) As shown in FIG. 2, each channel fader of the six channels with limiters has a setting of +8.3 dB.

Figure 3:
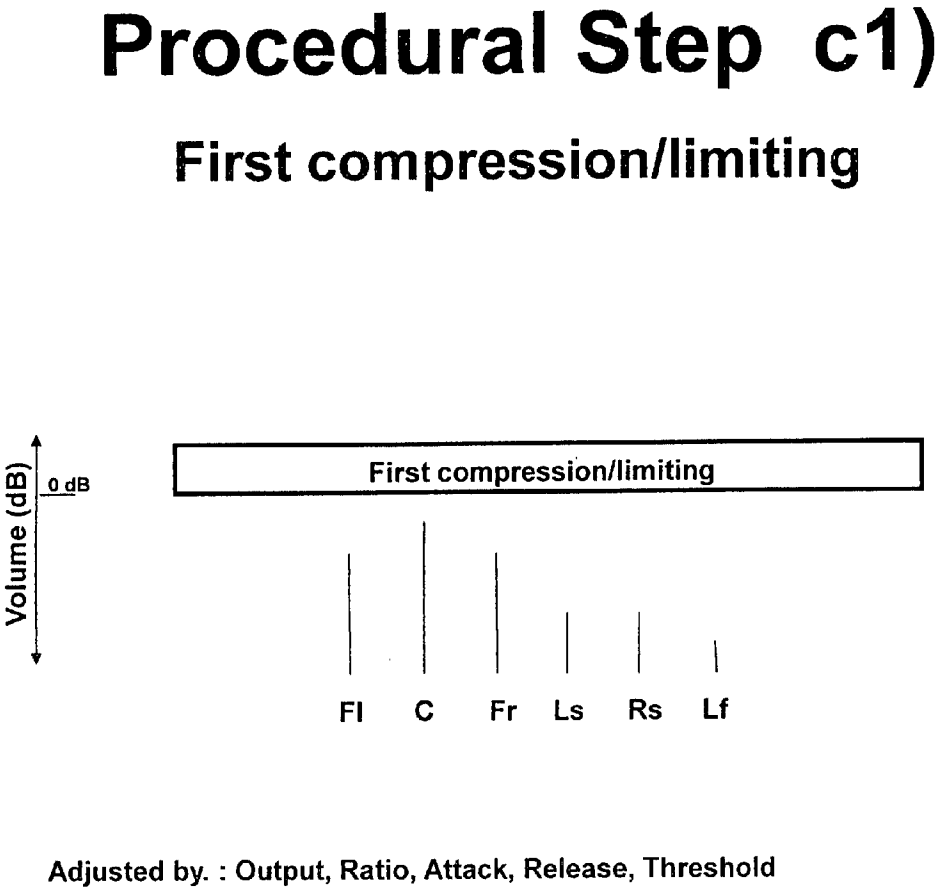
FIG. 3 shows the first compression/limiting of procedural step c1) of the invention.
Figure 4:
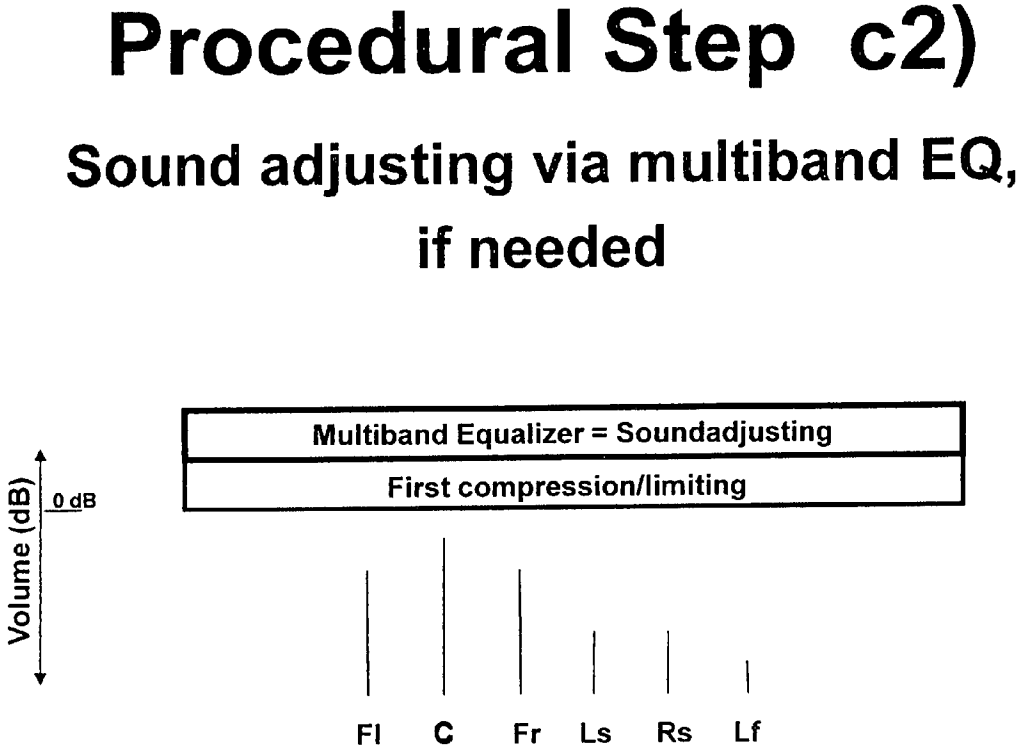
FIG. 4 shows the sound adjusting via multiband EQ of procedural step c2) of the invention.

One therefore overruns each of the six channels by 8.3 dB. This is important because in this manner, the six individual channels, which are actually too quiet, are strengthened once again.

c) As shown in FIGS. 3 and 4, each of the six limiters has a "threshold" value of −3.3 dB.

The "threshold" value indicates the threshold value of the signal applied to the channel fader, starting from which the limiter starts to work. A limiter works in such a manner that it limits the signal as soon as the signal exceeds the threshold value. In contrast to a compressor, however, this takes place in rather simplified manner, since it reacts immediately, while a compressor keeps multiple deficit individual settings available, as to how precisely compression is to take place. The limiter has more of the properties of a signal compression. If, in the present case, the value exceeds −3.3 dB, then limiting takes place from the top (and the signal thereby gains loudness, in that the energy within the system is increased, because the level cannot increase further), specifically in such manner that it nevertheless does not change its character. If all the channels were simply strongly limited, the result would appear strong, but flat and without depth, and with a "pumping" effect.

Figure 5:
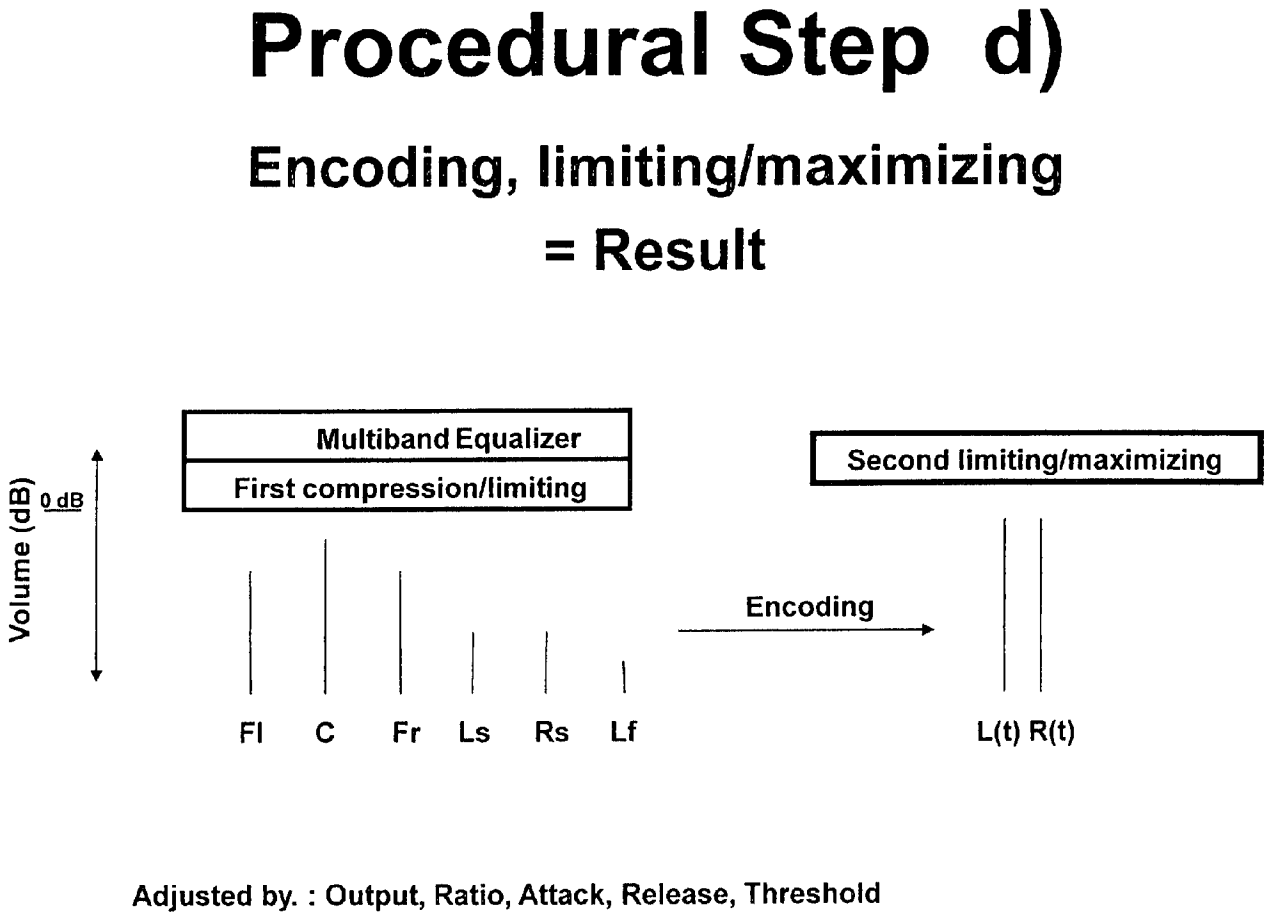
FIG. 5 shows the encoding, limiting/maximizing of procedural step d) of the invention.

The threshold value at the channel C can vary in terms of threshold value—depending on the audio to be processed.

d) As shown in FIG. 5, each limiter has a "release" value of 1.00

The "release" value states how long the limiter needs to return to the zero position after the applied signal has dropped back down below the threshold value. If a signal goes above the threshold limit, the limiter limits the level. If the signal drops again, there are multiple possibilities for selecting the "release" value.

e) The "output level" value

The "output level" value indicates the strength of the signal applied to the channel after processing by the limiter. This is fundamentally a normal signal amplifier/limiter. The advantage of this value is that a fixed configuration can be found, which allows finding the correct ratios of the volumes again—both in the later stereo/mono mode but also in all the surround formats.

Advantageous settings are:

| | |
|---|---|
| Channel "FL": | −17.5 db |
| Channel "FR": | −17.5 db |
| Channel "C": | −17.5 db |
| Channel "LS": | −18.5 db |
| Channel "RS": | −18.5 db |
| Channel "LFE": | −18.5 db |

The "output level" value of channel C can vary, depending on the audio material to be processed.

This configuration therefore stabilizes the mix again. The basically very low output level values come about in that the mix is recharged again tremendously, in terms of energy, since in the encoding process, six channels become two channels again (Lt, Rt). Therefore the result is potentization of the energy. In the case of higher output level values, strong overload occurs during coding, with the result that the mix is destroyed.

For the further limiting by means of a compressor/limiter/maximizer provided subsequent to method step d), the following values should preferably be selected:

a) Threshold

The threshold value cannot be standardized. Here, hearing dictates: The farther one pulls the value down (i.e. the sooner the maximizer starts to work), the more loudness does the encoded mix get, with a changing frequency and therefore sound. This setting is audio-dependent. The more loudness the original signal has (e.g. dance music), the less threshold is required. A threshold value of −2.6 dB has proven to be advantageous.

b) Output Level

The out-ceiling value of −0.1 dB has proven itself with practically all mixes. After the threshold value is set and the signal amounts to − (minus) 0.1 dB, the level peaks within the mix are intercepted, as the result of the single channel addition within the surround mix. In this connection, over-driving of the 0 dB mark is avoided.

This yields a result that sounds just as good as or better than the stereo original, but looks different in terms of amplitude.

The sound result appears to be more dynamic, with simultaneously increasing loudness, something that is normally mutually exclusive, in general. While audio material normally becomes louder but less dynamic as the result of compression/limiting, this is not mutually exclusive in the method being discussed here, but rather, it is possible to achieve a gain both in dynamics and in loudness.

c) Release Value

In the maximizer, a "release" value of 1.00 is used. This has proven itself in that the result sounds original.

By means of an optimal setting of all the values within the invented method, better sound quality is produced in any audio surroundings, as compared with the original.

This method can also be applied to finished, produced individual tracks of a surround mix (discrete tracks), to form them into an Lt, Rt track.

The invention claimed is:

1. Method for multi-channel processing in a multi-channel sound system, particularly using surround multi-channel sound technology, having the following method steps:

a) splitting a channel or a channel mixture into individual channels;

b) processing the resulting individual channels by means of setting a parameter channel fader;

c) compressing and/or limiting the individual channels by means of setting the values of the parameters channel fader, threshold, release, and output level;

d) encoding the individual channels by adding audio components of the data that lie in surround channels to FL and FR channels with a phase rotation of +/−90 degrees and embedding said audio components in the FL and FR channels with lowering of volume level, wherein the channel faders are set to a uniform value in method step b), and at least two channels are limited with a uniform output level value in method step c), whereby one channel C (center) can vary, in terms of output level value, and every further channel is limited in such a manner that it has an output level value that is at least one decibel less than the uniform output level value of the two channels, whereby subsequent to method step d), a further compression and/or limiting of the encoded channels by means of a compressor/limiter/maximizer takes place by means of setting a value of at least one of the parameters channel fader, threshold, release, and output level.

2. Method according to claim 1, wherein at least one channel fader is set above the uniform value.

3. Method according to claim 1, wherein the values of the channel faders, after splitting of a channel or a channel group into individual channels, are identical for all channels.

4. Method according to claim 3, wherein at least one channel fader is set above the identical value.

5. Method according to claim 4, wherein the identical channel fader value is set to −5 dB to +2 dB, preferably to 0 dB.

6. Method according to claim 1, wherein channel C (center) lies above the uniform output level value after limiting, and/or channel C (center) deviates by between +0.1 and +10 dB in relation to the other channel faders, and/or the channel fader value of the channel C is set to +2.3 dB, and/or in method step c), a uniform output level value of the channels FL, FR is set.

7. Method according to claim 6, wherein an output level value between −8.0 dB and −24.0 dB is set, and/or the output level value is set to −17.5 dB, and/or in method step c), in addition, a uniform output level value of the channels LS, BL, BR, RS, LFE is set, and/or an output level value between −9.0 dB and −25.0 dB is set, and/or the output level value is set to −18.5 dB, and/or a deviating output level value is set for the individual channel, and/or in method step c), a channel fader value between 7 dB and 10 dB is set.

8. Method according to claim 7, wherein the channel fader value is set to 8.3 dB, and/or in method step c), a threshold value between −1 dB and −10 dB is set, and/or the threshold value is set to −3.3 dB, and/or in method step c), a release value between 0.5 and 2.0 is set, and/or a release value of 1.0 is set.

9. Method according to claim 1, wherein subsequent to method step d), a threshold value between −1.0 dB and −10.0 dB is set, and/or the threshold value is set to −2.6 dB, and/or subsequent to method step d), an output level value between 0 dB and −1 dB is set, and/or an output level value of −0.1 dB is set.

10. Method according to claim 1, wherein subsequent to method step d), a release value between 0.5 and 2.0 is set, and/or the release value is set to 1.0.

* * * * *